US006128838A

United States Patent [19]

Morlock

[11] Patent Number: 6,128,838

[45] Date of Patent: Oct. 10, 2000

[54] HEATED BUCKET SYSTEM

[76] Inventor: Gary W. Morlock, 5180 57th St. SE., Bismarck, N. Dak. 58504

[21] Appl. No.: 09/336,027

[22] Filed: Jun. 16, 1999

[51] Int. Cl.[7] ..... E02F 3/40

[52] U.S. Cl. ..... 37/444; 37/200; 37/228

[58] Field of Search ..... 37/443, 444, 199, 37/200, 227, 228, 229, 903; 404/77, 79, 95

[56] References Cited

U.S. PATENT DOCUMENTS

| | | |
|---|---|---|
| 1,127,407 | 2/1915 | Clayborne . |
| 2,086,469 | 7/1937 | Bullard . |
| 3,824,718 | 7/1974 | Nekrasov et al. . |
| 4,033,055 | 7/1977 | Lazarecky . |
| 4,034,489 | 7/1977 | Hughes, Jr. . |
| 5,515,623 | 5/1996 | Weeks . |

*Primary Examiner*—H. Shackelford
*Attorney, Agent, or Firm*—Michael S. Neustel

[57] ABSTRACT

A heated bucket system for significantly reducing the accumulation of frozen mud and ice within a bucket thereby maintaining the bucket's dirt moving capacity. The inventive device includes a bucket attachable to an arm of a backhoe or other machinery, a pump attached to the coolant system of the backhoe, an inflow tube fluidly connected to the pump, a heat tube attached to the back member of the bucket preferably in a sinusoidal pattern and fluidly connected to the inflow tube, and an outflow tube fluidly connected to the heat tube opposite of the inflow tube and fluidly connected to the coolant system of the backhoe. In operation, the pump draws the heated coolant within the coolant system and pumps it through the heat tube attached to the bucket. The heat from within the coolant is exchanged with the bucket thereby maintaining the temperature of the bucket above freezing. The coolant is then returned to the coolant system through an outflow tube. The heated bucket prevents the mud and water from freezing within the bucket during operation thereby maintaining the earth moving capacity of the backhoe in cold weather conditions. The invention also operates to maintain earth moving capacity during warm weather conditions by preventing the accumulation of mud and sticky dirt.

20 Claims, 3 Drawing Sheets

HEATED BUCKET SYSTEM

BACKGROUND OF THE INVENTION

1. Field of the Invention

The present invention relates generally to buckets for backhoes/excavators and more specifically it relates to a heated bucket system for significantly reducing the accumulation of frozen mud and ice within a bucket thereby maintaining the bucket's dirt moving capacity.

Backhoe operators often times must operate their machinery during cold weather conditions. When utilizing their machines, the buckets will accumulate mud and water within them when digging into moist ground. This mud and water then eventually becomes frozen within the interior portion of the bucket. Over a period of time this accumulated frozen material begins to significantly reduce the amount of interior volume within the bucket thereby significantly reducing the earth moving capacity. Even during warm weather conditions the mud will accumulate within the bucket. Hence, there is a need for a system that significantly reduces the amount of accumulated mud and ice within a bucket.

2. Description of the Prior Art

Backhoes and other excavating equipment have been in use for years. Typically, the backhoe has a frame, a motor, a bucket arm, and a bucket attached to the bucket arm. The user operates the bucket through hydraulic levers to dig the earth and move it to a desired location. When the outside temperature drops below freezing, water and mud begin to freeze within the bucket. The only currently utilized method of removing the frozen mud and water is to physically remove the frozen debris with a hard object such as a hammer or elongate shaft.

When the backhoe operator has to leave the machine to remove the frozen debris, the backhoe is not in operation making the user and the backhoe very unproductive. If the operator allows the debris to significantly accumulate within the bucket, the volume of earth that can be moved is significantly reduced thereby reducing productivity. In addition, often times the debris will accumulate within the bucket without the user being aware of the accumulation.

Examples of attempts to reduce the amount of frozen debris include U.S. Pat. No. 1,376,741 to J. L. Boyle; U.S. Pat. No. 1,127,407 to E. Clayborne; U.S. Pat. No. 5,515,623 to Weeks; U.S. Pat. No. 4,032,015 to Hemphill; U.S. Pat. No. 3,872,986 to Campbell; U.S. Pat. No. 4,324,307 to Schittino et al. which are all illustrative of such prior art.

J. L. Boyle (U.S. Pat. No. 1,376,741) discloses a steam heated snowplow. Boyle teaches a snowplow for a locomotive with the plow member having two walls connected by stay bolts with the stay bolts perforated to allow steam which enters the cavity to pass upwardly into direct contact with the snow upon the outer surface of the plow for melting the snow.

E. Clayborne (U.S. Pat. No. 1,127,407) discloses a snow plow. Clayborne teaches a plow member attachable to a locomotive wherein the plow member has a radiator that receives steam from the locomotive for melting and removing snow.

While these devices may be suitable for the particular purpose to which they address, they are not as suitable for significantly reducing the accumulation of frozen mud and ice within a bucket thereby maintaining the bucket's dirt moving capacity. There currently is no available system for removing ice and frozen mud from a bucket of a backhoe or excavating machine. In addition, conventional methods of removing frozen debris within a bucket are extremely time intensive making the user extremely inefficient.

In these respects, the heated bucket system according to the present invention substantially departs from the conventional concepts and designs of the prior art, and in so doing provides an apparatus primarily developed for the purpose of significantly reducing the accumulation of frozen mud and ice within a bucket thereby maintaining the bucket's dirt moving capacity.

SUMMARY OF THE INVENTION

In view of the foregoing disadvantages inherent in the known types of backhoe devices now present in the prior art, the present invention provides a new heated bucket system construction wherein the same can be utilized for significantly reducing the accumulation of frozen mud and ice within a bucket thereby maintaining the bucket's dirt moving capacity. The invention also prevents the accumulation of mud and dirt during warm weather conditions.

The general purpose of the present invention, which will be described subsequently in greater detail, is to provide a new heated bucket system that has many of the advantages of the backhoe devices mentioned heretofore and many novel features that result in a new heated bucket system which is not anticipated, rendered obvious, suggested, or even implied by any of the prior art backhoe devices, either alone or in any combination thereof.

To attain this, the present invention generally comprises a bucket attachable to an arm of a backhoe or other machinery, a pump attached to the coolant system of the backhoe, an inflow tube fluidly connected to the pump, a heat tube attached to the back member of the bucket preferably in a sinusoidal pattern and fluidly connected to the inflow tube, and an outflow tube fluidly connected to the heat tube opposite of the inflow tube and fluidly connected to the coolant system of the backhoe. In operation, the pump draws the heated coolant within the coolant system and pumps it through the heat tube attached to the bucket. The heat from within the coolant is exchanged with the bucket thereby maintaining the temperature of the bucket above freezing. The coolant is then returned to the coolant system through an outflow tube. The heated bucket prevents the mud and water from freezing within the bucket during operation thereby maintaining the earth moving capacity of the backhoe in cold weather conditions.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a heated bucket system that will overcome the shortcomings of the prior art devices.

Another object is to provide a heated bucket system that efficiently removes accumulated frozen debris within a bucket of a backhoe or excavating machinery.

An additional object is to provide a heated bucket system that reduces the amount of time wasted by a backhoe operator cleaning the bucket of a backhoe.

A further object is to provide a heated bucket system that maintains the amount of earth moving capacity for a backhoe.

Another object is to provide a heated bucket system that lowers the cost of production to the user because the bucket has a maximum dirt moving capacity.

A further object is to provide a heated bucket system that prevents mud and water from freezing within the interior of the bucket.

Another object is to provide a heated bucket system that prevents the accumulation of mud and dirt within a bucket even during warm weather conditions.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
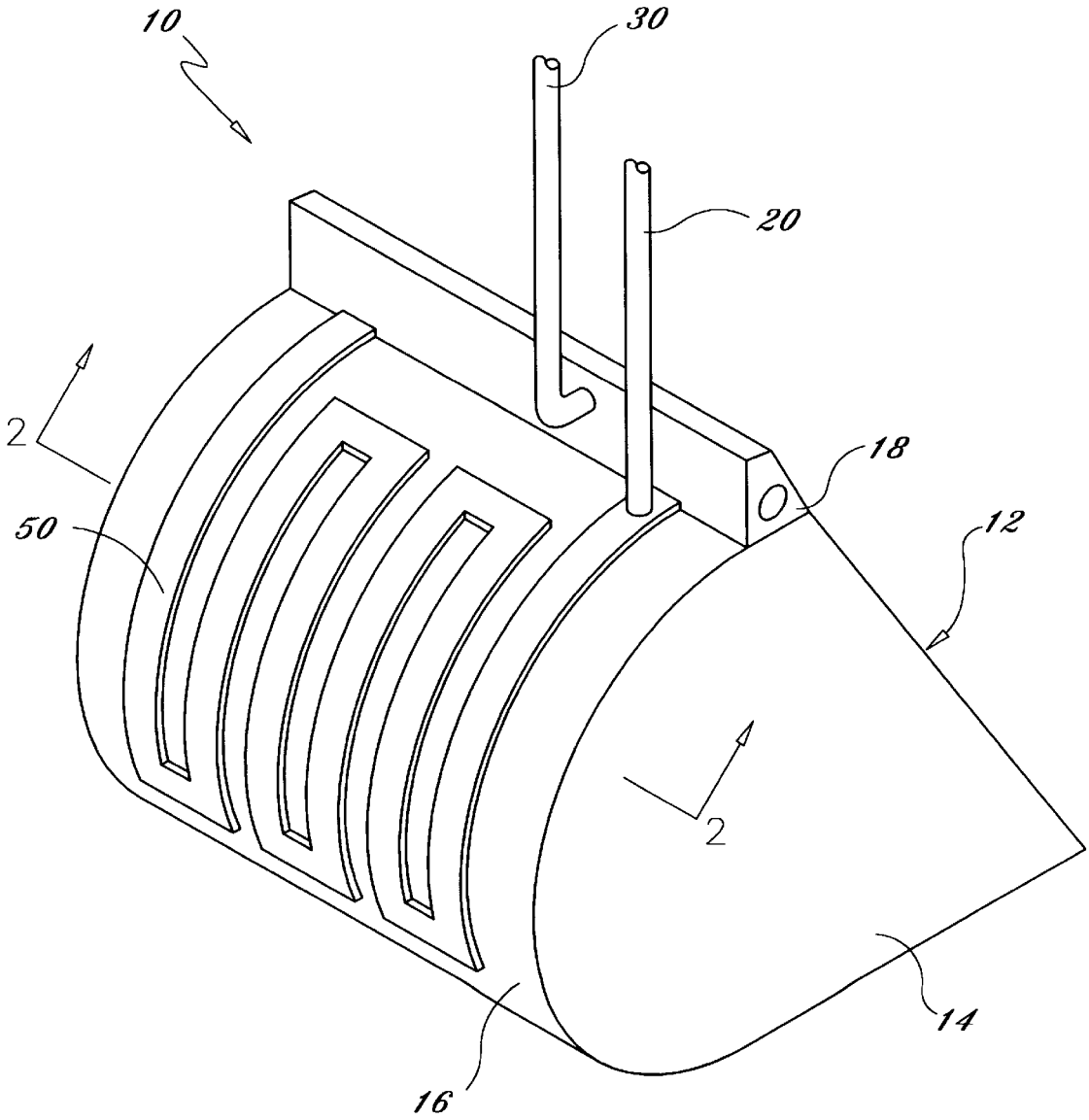
FIG. 1 is an upper perspective view of the present invention within the bucket.
Figure 2:
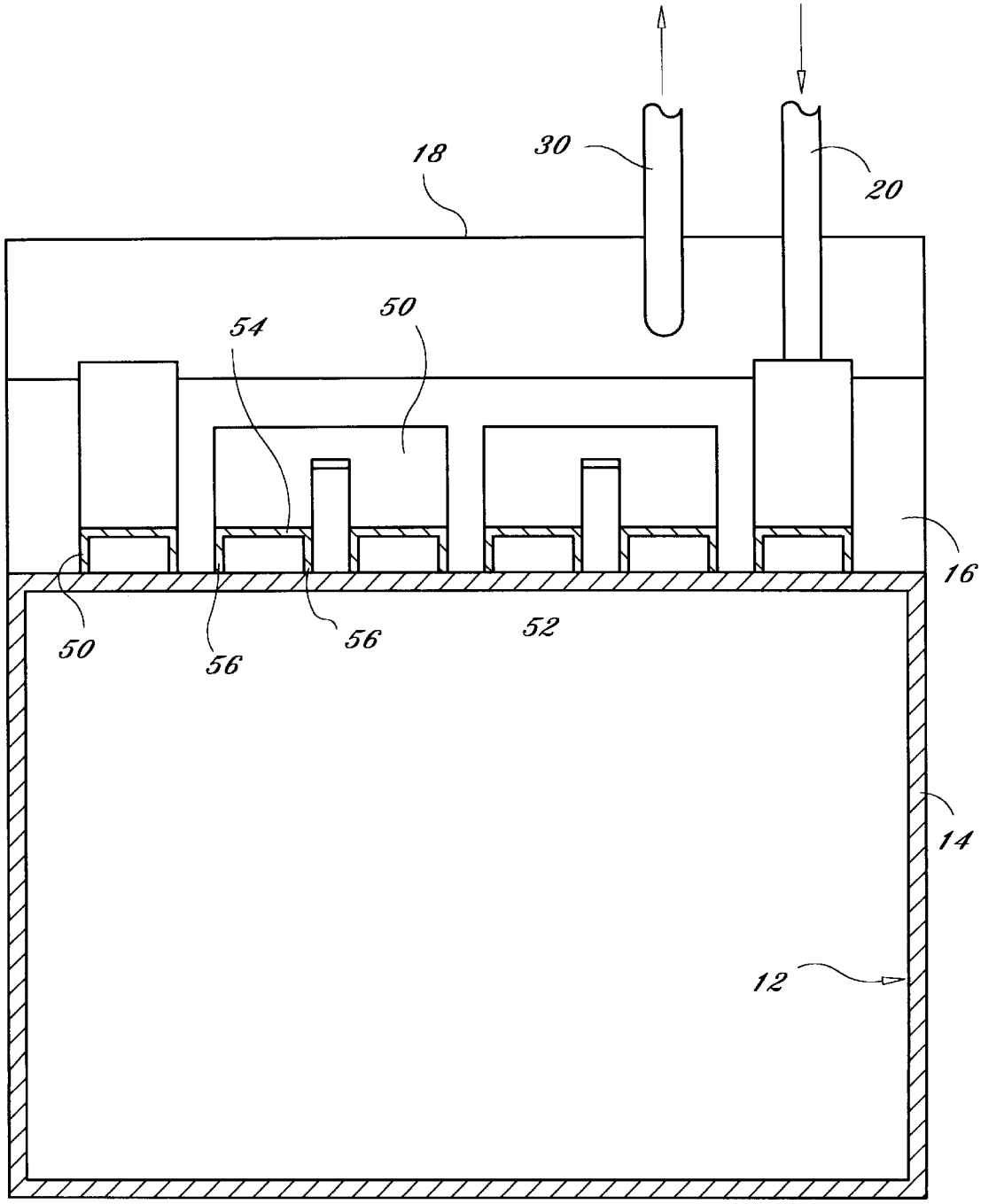
FIG. 2 is a cross sectional view taken along line 2—2 of FIG. 1 of the drawings.
Figure 3:
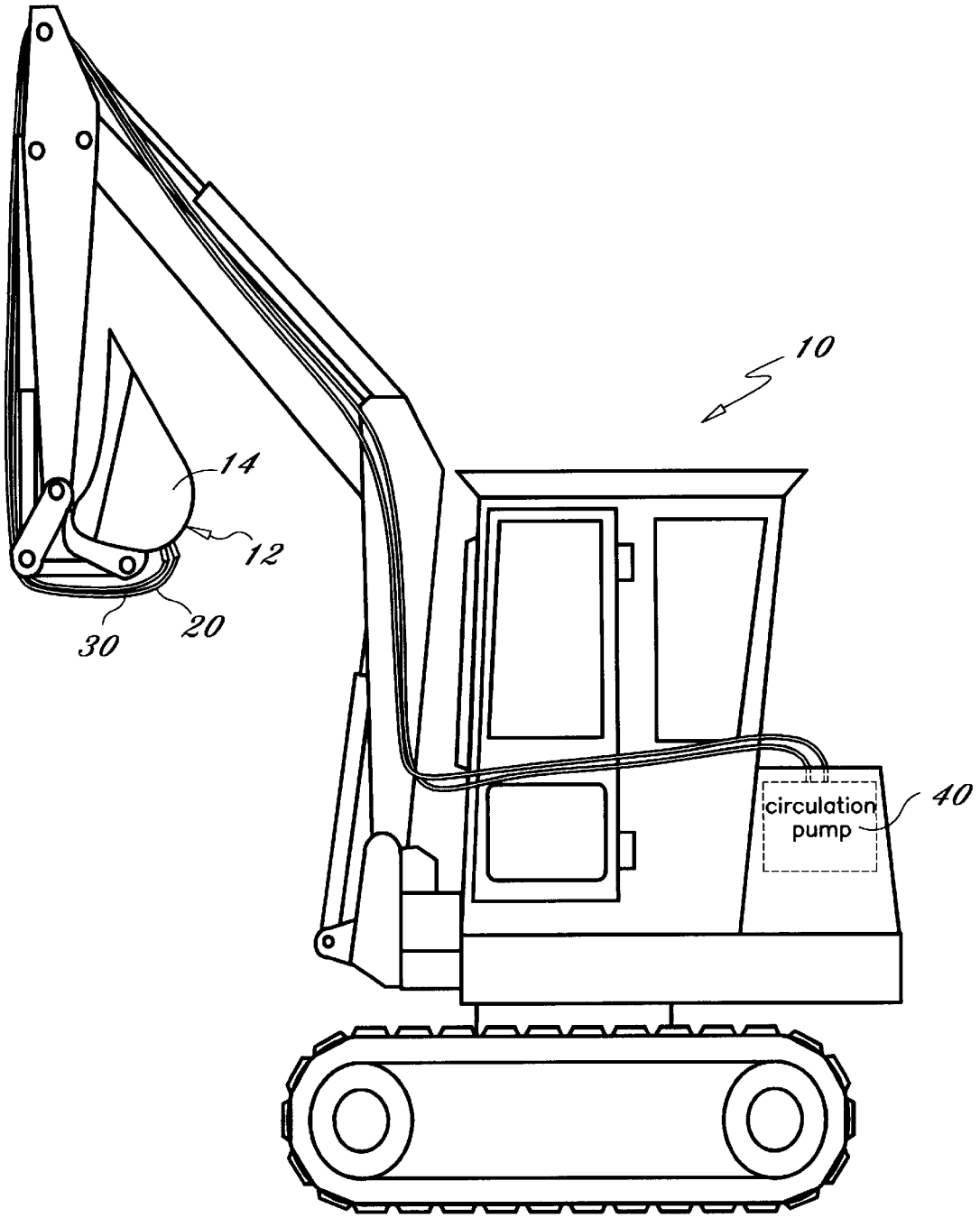
FIG. 3 is a side view of the present invention attached to a conventional backhoe.

Turning now descriptively to the drawings, in which similar reference characters denote similar elements throughout the several view, FIGS. 1 through 3 illustrate a heated bucket system 10, which comprises a bucket 12 attachable to an arm of a backhoe or other machinery, a pump 40 attached to the coolant system of the backhoe, an inflow tube 20 fluidly connected to the pump 40, a heat tube 50 attached to the back member 16 of the bucket 12 preferably in a sinusoidal pattern and fluidly connected to the inflow tube 20, and an outflow tube 30 fluidly connected to the heat tube 50 opposite of the inflow tube 20 and fluidly connected to the coolant system of the backhoe. In operation, the pump 40 draws the heated coolant within the coolant system and pumps it through the heat tube 50 attached to the bucket 12. The heat from within the coolant is exchanged with the bucket 12 thereby maintaining the temperature of the bucket 12 above freezing. The coolant is then returned to the coolant system through an outflow tube 30. The heated bucket 12 prevents the mud and water from freezing within the bucket 12 during operation thereby maintaining the earth moving capacity of the backhoe in cold weather conditions.

As best shown in FIGS. 1 and 2, the bucket 12 is shaped similar to a conventional bucket 12 for a backhoe or other excavating machine. The bucket 12 generally has a pair of sides 14, a floor, and a back member 16. The back member 16 is generally curved as shown in FIG. 1 of the drawings. There also is generally a plurality of teeth extending from the floor of the bucket 12 for engaging the earth surface. As best shown in FIG. 1 of the drawings, a bracket structure 18 is attached to an upper portion of the back member 16. The bracket structure 18 generally is hollow and sealed with respect to the exterior.

The bucket 12 is pivotally attached to an arm structure of a conventional backhoe by the bracket structure 18 as shown in FIG. 3 of the drawings. It can be appreciated by one skilled in the art that the bucket 12 may have various other shapes and configurations to achieve the same results.

As shown in FIGS. 1 and 2 of the drawings, a heat tube 50 is attached to the back member 16. The heat tube 50 preferably covers a substantial portion of the back member 16 as shown in FIG. 1 of the drawings for providing the best heat distribution to the back member 16 of the bucket 12. The heat tube 50 is preferably one single sinusoidal member as shown in FIG. 1 of the drawings. However, it can be appreciated by one skilled in the art that the heat tube 50 may have various portions interconnected to one another for engaging a substantial portion of the back member 16.

As best shown in FIG. 2 of the drawings, the heat tube 50 is preferably comprised of a pair of side walls 56 and an upper wall 54 defining a channel 52 there between. The side walls 56 are secured to the exterior surface of the back member 16 by conventional means such as welding so as to enclose the channel 52 as shown in FIG. 2 of the drawings. The heat tube 50 can also be constructed from a single curved member forming a semi-tubular structure attached to the back member 16.

The heat tube 50 is preferably only attached to an upper portion of the back member 16 as shown in FIG. 1 for preventing wearing and damage to the heat tube 50 during operation. It can also be appreciated by one skilled in the art that the heat tube 50 can be integral within the back member 16 through conventional processes.

As shown in FIGS. 1 and 2, an inflow tube 20 is fluidly connected to an end of the heat tube 50. The inflow tube 20 extends about the arm of the backhoe to a pump 40 as shown in FIG. 3 of the drawings. The pump 40 is fluidly connected to the coolant system of the backhoe or other excavating equipment for drawing the heated coolant within the coolant system. The pump 40 then forces the heated coolant through the inflow tube 20 into the heat tube 50 for heating the bucket 12. An outflow tube 30 is fluidly connected to the opposing end of the heat tube 50 either directly or through the hollow bracket structure 18 as shown in FIG. 1 of the drawings. The outflow tube 30 returns the coolant back to the coolant system of the backhoe to be reheated.

In an alternative embodiment, a separate reservoir would be fluidly connected to the pump 40 instead of the coolant system. The reservoir would contain a sufficient amount of coolant and would include a heating device for heating the fluid within. The pump 40 would then pump 40 the heated coolant from the reservoir into the heat tube 50 and the outflow tube 30 would return the coolant to the reservoir to be reheated.

In use, the user operates the backhoe as usual. As the engine is operated, the engine heats the coolant within the coolant system. The pump 40 draws this heated coolant from the coolant system and forces the heated coolant through the inflow tube 20 into the heat tube 50. The heat tube 50 is directly connected to or within the back member 16 of the bucket 12 thereby heating the back member 16 to a temperature above freezing. The heated back member 16 prevents freezing of the mud and water onto the bucket 12 during operation. The heated back member 16 also reduces the accumulation of mud and sticky dirt during warm weather conditions as can be appreciated by one skilled in the art. The heated coolant passes through the heat tube 50 into either the bracket structure 18 or directly into the outflow tube 30. The coolant is then forced back into the coolant system where it is reheated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A heated bucket system, comprising:

a bucket having a pair of sides, a floor, and a back member;

a pump fluidly connectable to a coolant system of a vehicle;

a heat tube connected to said back member, wherein said heat tube is fluidly connected between said pump and said coolant system.

2. The heated bucket system of claim 1, wherein said heat tube is an elongate structure.

3. The heated bucket system of claim 2, wherein said heat tube engages a substantial portion of said back member.

4. The heated bucket system of claim 3, wherein said heat tube has a sinusoidal pattern attached to said back member.

5. The heated bucket system of claim 4, wherein said heat tube is fluidly connected to said pump by an inflow tube.

6. The heated bucket system of claim 5, wherein said heat tube has at least one wall.

7. The heated bucket system of claim 6, wherein said heat tube is attached to an upper portion of said back member.

8. The heated bucket system of claim 7, wherein said heat tube comprises:

a pair of side walls; and an upper wall attached to said pair of side walls forming a U-shape.

9. The heated bucket system of claim 8, wherein said heat tube is fluidly connected to said coolant system by an outflow tube.

10. The heated bucket system of claim 8, wherein said heat tube is fluidly connected to said coolant system through a bracket structure of said bucket which is fluidly connected to said coolant system by an outflow tube.

11. A heated bucket system, comprising:

a bucket having a pair of sides, a floor, and a back member;

a heated reservoir;

a pump fluidly connectable to said heated reservoir;

a heat tube connected to said back member, wherein said heat tube is fluidly connected between said pump and said heated reservoir.

12. The heated bucket system of claim 11, wherein said heat tube is an elongate structure.

13. The heated bucket system of claim 12, wherein said heat tube engages a substantial portion of said back member.

14. The heated bucket system of claim 13, wherein said heat tube has a sinusoidal pattern attached to said back member.

15. The heated bucket system of claim 14, wherein said heat tube is fluidly connected to said pump by an inflow tube.

16. The heated bucket system of claim 15, wherein said heat tube has at least one wall.

17. The heated bucket system of claim 16, wherein said heat tube is attached to an upper portion of said back member.

18. The heated bucket system of claim 17, wherein said heat tube comprises:

a pair of side walls; and an upper wall attached to said pair of side walls forming a U-shape.

19. The heated bucket system of claim 18, wherein said heat tube is fluidly connected to said heated reservoir by an outflow tube.

20. The heated bucket system of claim 18, wherein said heat tube is fluidly connected to said heated reservoir through a bracket structure of said bucket which is fluidly connected to said heated reservoir by an outflow tube.

* * * * *